US006578205B1

(12) United States Patent
King

(10) Patent No.: US 6,578,205 B1
(45) Date of Patent: Jun. 17, 2003

(54) DISPOSABLE GLOVE

(76) Inventor: Cecelia M. King, 5900 E. Thomas Rd., Apt. F104, Scottsdale, AZ (US) 85251

( * ) Notice: Subject to any disclaimer, the term of this patent is extended or adjusted under 35 U.S.C. 154(b) by 0 days.

(21) Appl. No.: 09/954,938

(22) Filed: Sep. 18, 2001

(51) Int. Cl.[7] ..... A41D 19/00

(52) U.S. Cl. ..... 2/161.7; 2/16; 206/278; 600/38

(58) Field of Search ..... 2/16, 20, 160, 2/161.7, 163, 161.8; 128/878, 879; 604/349; 206/569–571, 581, 363, 368, 438, 497, 803, 828, 810, 823, 213, 278; 600/38

(56) References Cited

U.S. PATENT DOCUMENTS

| | | | | | |
|---|---|---|---|---|---|
| 3,761,965 | A | | 10/1973 | Barasch | |
| 3,892,314 | A | * | 7/1975 | Semp | 206/363 |
| 4,068,757 | A | * | 1/1978 | Casey | 206/363 |
| 4,069,913 | A | * | 1/1978 | Harrigan | 206/278 |
| 4,329,312 | A | | 5/1982 | Ganz | |
| 4,793,354 | A | | 12/1988 | Wright et al. | |
| 4,852,783 | A | * | 8/1989 | Bryden et al. | 224/253 |
| 4,951,815 | A | * | 8/1990 | Ulbrich | 206/213 |
| 5,065,863 | A | * | 11/1991 | Moyet-Ortiz | 206/210 |
| 5,138,719 | A | | 8/1992 | Orlianges et al. | |
| 5,614,202 | A | | 3/1997 | Defina | |
| 5,620,773 | A | | 4/1997 | Nash | |
| 5,704,670 | A | * | 1/1998 | Surplus | 294/25 |
| 5,934,462 | A | * | 8/1999 | Gregory | 206/278 |
| RE36,778 | E | * | 7/2000 | DeLeo | 2/161.7 |
| 6,081,928 | A | * | 7/2000 | Bourne | 2/161.8 |

* cited by examiner

*Primary Examiner*—John J. Calvert
*Assistant Examiner*—Katherine Moran
(74) *Attorney, Agent, or Firm*—Parsons & Goltry; Robert A. Parsons; Michael W. Goltry

(57) ABSTRACT

Disclosed is a disposable glove for use in sexual exercises to promote increased pleasure and guard against sexually transmitted diseases. The glove is fabricated of a thin, highly flexible material such as latex, and lubricant is applied to the glove. Ridges, knobs or other protrusions or texturing are formed on the glove for added tactile sensation. The glove is contained in a sealed package to preserve the lubricant and for ease in use and convenience.

19 Claims, 1 Drawing Sheet

DISPOSABLE GLOVE

FIELD OF THE INVENTION

This invention relates to gloves and, more particularly, to a packaged, pre-lubricated disposable glove.

BACKGROUND OF THE INVENTION

Those that are sexually active with different partners are prone to contracting sexually transmitted diseases (STDs) such as herpes, genital warts, gonorrhea, syphilis, human immunodeficiency virus (HIV), etc. In an effort to reduce the spread of STDs, considerable effort has been and continues to be directed by many toward educating people about the risks of unprotected sex and how condoms and especially abstinence can greatly reduce the risk of contracting STDs. Although condoms are efficient, convenient and prove exemplary for reducing the transmission of STDs during intercourse, STDs are not only transmitted by intercourse. For instance, many people believe that intercourse and oral sex are the only ways to contract STDs. However, open sores on the hands can often lead to the transmission of STDs as a result of hand fondling others genitals and inserting fingers into bodily openings.

Given peoples' continuing ignorance about the transmission of STDs and the ability of STDs to transmit from simple hand fondling and inserting fingers into bodily openings, there is a need for a pre-lubricated glove that is easy to use and convenient and that incorporates lubrication and texturing for enhance tactile sensation while guarding against the transmission of STDs.

SUMMARY OF THE INVENTION

The above problems and others are at least partially solved and the above purposes and others realized in a new and improved disposable glove for use in sexual exercises to guard against sexually transmitted diseases and promote increased pleasure. The glove is fabricated of a thin, highly flexible material such as latex. Lubricant is applied liberally to the glove. Texturing such as ridges, knobs or other protrusions are disposed on the glove for added tactile sensation. The glove includes a palm and finger stalls, and the texturing is disposed at the palm, and at the finger stalls along the palm side of the glove. The texturing can be applied only at the palm, only at the finger stalls or only at one of the finger stalls, and preferably at least at the palm. The texturing is affixed to the glove and preferably formed with the glove during manufacture. The glove is contained in a sealed package to preserve the lubricant and for ease in use.and convenience.

In accordance with the principle of the invention, also provided is a method that includes providing a thin, flexible glove that is capable of being fitted over a human hand, with texturing disposed with the glove for enhanced tactile sensation, lubricating the glove, and disposing the glove within a sealed package.

BRIEF DESCRIPTION OF THE DRAWINGS

Referring to the drawings.

DETAILED DESCRIPTION OF A PREFERRED EMBODIMENT

Figure 1:
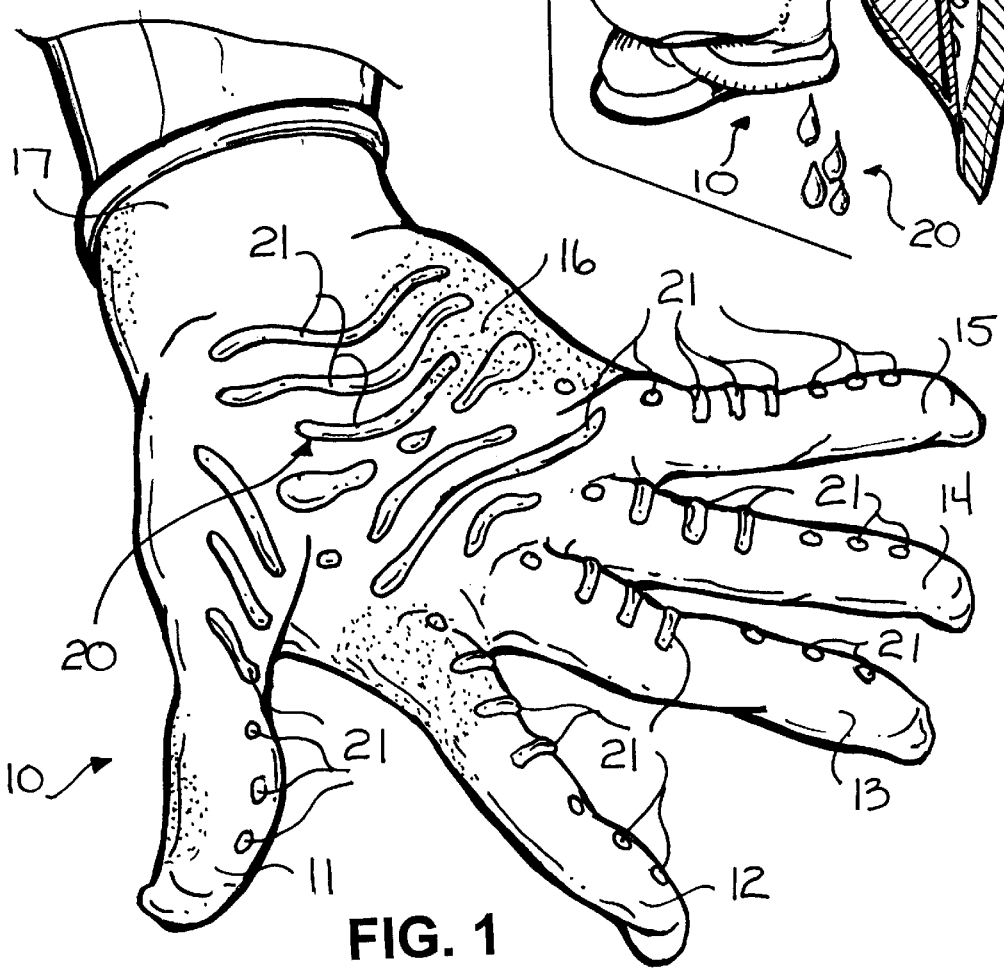
FIG. 1 is a perspective view of a lubricated glove having protrusions for enhanced tactile sensation, in accordance with the principle of the invention, shown as it would appear fitted over a human hand.

Turning now to the drawings, in which like reference characters indicate corresponding elements throughout the several views, attention is first directed to FIG. 1 in which is seen a glove, embodying the principle of the instant invention, generally indicated by the reference character 10 and which is capable of being fitted over a human hand as illustrated or left hand. Glove 10 has five finger stalls, namely, a thumb stall 11, an index finger stall 12, a middle finger stall 13, a ring finger stall 14 and a pinky finger stall 15, a palm 16 and a cuff 17. Glove 10 is made of very thin, highly flexible rubber or a rubberlike plastic such as latex and is disposable.

Figure 3:
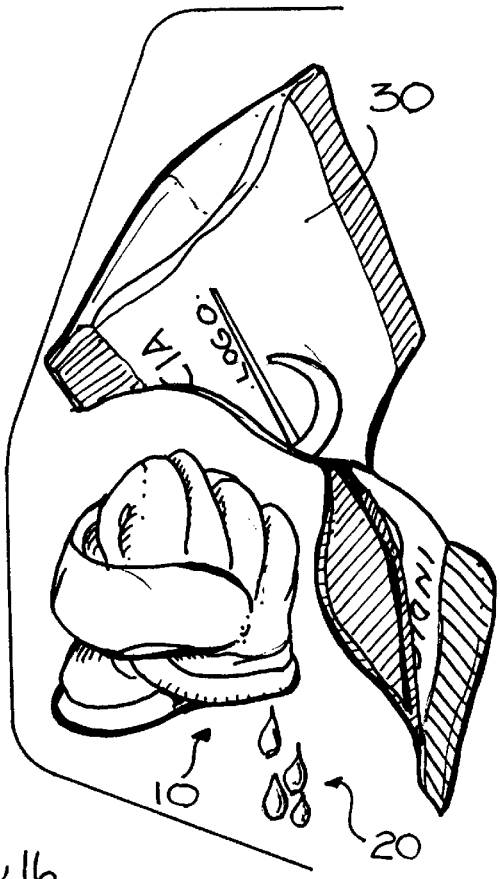
FIG. 3 is a perspective view of the package of FIG. 2 as it would appear open with the glove of FIG. 1 removed therefrom.

Glove 10 is lubricated with lubricant, generally designated by the reference character 20 in FIG. 3, which is disposed on or otherwise applied to glove 10. Lubricant 20 is any known form of non-toxic, non-allergenic gel or semi-liquid gel and is applied liberally to the exterior of glove 10. Glove 10 is fashioned with texturing 19, which is attached to or formed with glove 10 and preferably the latter. Texturing 19 is characterized by raised features or protrusions 21 in the form of ridges, knobs, etc., which are disposed at palm 16 and along finger stalls 11–15 on the palm side of glove 10. Other protrusion forms can be employed such as bumps, ribs, swirls, etc., for enhancing tactile sensation.

Glove 10 is capable of being fitted over a human hand as in FIG. 1 for use in sexual exercises to promote increased pleasure and guard against sexually transmitted diseases. Lubricant 20 greatly reduces friction between glove 10 and other surfaces and bodily openings and texturing 19 provides enhanced tactile sensation to worked surfaces.

Figure 2:
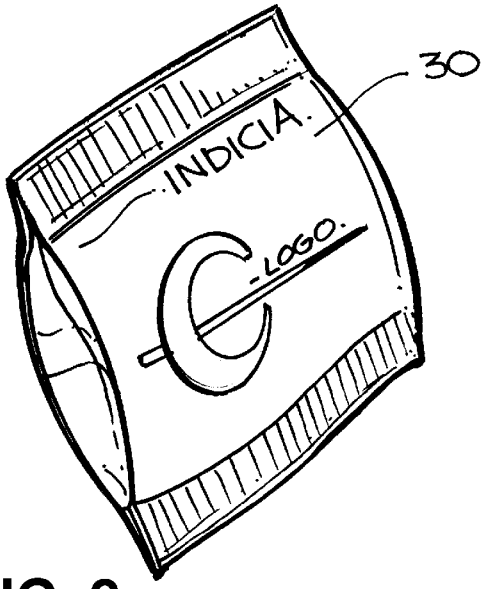
FIG. 2 is a perspective view of a sealed package containing the glove of FIG. 1.

With regard to FIG. 2, glove 10 is contained in a sealed package 30 to preserve lubricant 20 and for ease in use and convenience. Package 30 is formed of flexible, fluid tight material such as polyethylene plastic and other similar materials can be used. Package 30 is heat sealed, and it can be sealed in other ways, with adhesive sealing being a suitable example. Package 30 can be opaque, but it is preferably transparent or semi-transparent to enable viewing of the contents held therein, namely, lubricated glove 10.

Package 30 is relatively small and is, for example, capable of being stored in a small purse. Package 30 is capable of being taken up by hand and opened for the purpose of accessing and removing glove 10 therefrom as represented in FIG. 3. Package 30 is capable of being torn open or pulled apart at its bonded seams. Package 30 can be formed with openable features designed to be used for facilitating an opening of package 30 if desired. After removing glove 10, it can then be fitted over a human hand for use in sexual exercises to promote increased pleasure and guard against sexually transmitted diseases, with lubricant 20 and texturing 30 providing exemplary tactile sensation.

In FIG. 1, glove 10 is formed to fit on a right hand. Glove 10 can be constructed to be capable of being fitted over a right hand. During manufacture, glove 10 can be manufactured as a right hand glove, exteriorly lubricated and then packaged. In order to provide a left hand glove, a manufactured right hand glove can be turned inside out so as to form a left hand glove, exteriorly lubricated and then packaged. This can be reversed by manufacturing a left hand glove and turning it inside out so as to form a right hand glove. Glove 10 can, however, be formed with texturing on each side and designed to be capable of being worn either on a right hand or a left hand as desired without having to be turned inside out. A glove such as this can be manufactured, exteriorly lubricated and then packaged.

The invention is described above with reference to one or more preferred embodiments. However, those skilled in the art will recognize that changes and modifications may be made to the described embodiments without departing from the nature and scope of the invention. Accordingly, any such changes and modifications to one or more of the embodiments herein chosen for purposes of illustration are intended to be included within the scope of the invention as assessed only by a fair interpretation of the ensuing claims.

Having fully described the invention in such clear and concise terms as to enable those skilled in the art to understand and practice the same, the invention claimed is:

1. Apparatus comprising:

a glove having an outer surface coated with a lubricating gel, the glove having texturing formed on the outer surface thereof and being capable of being fitted over a human hand; and a sealed package containing the glove.

2. Apparatus of claim 1, the glove further including:

a palm; and the texturing disposed at the palm for enhanced tactile sensation.

3. Apparatus of claim 1, the glove further including:

at least one finger stall; and the texturing disposed at the finger stall for enhanced tactile sensation.

4. Apparatus of claim 1, the glove further including:

a plurality of finger stalls; and the texturing disposed at the finger stalls for enhanced tactile sensation.

5. Apparatus of claim 2, wherein the texturing comprises protrusions formed with the palm.

6. Apparatus of claim 3, wherein the texturing comprises protrusions formed with the finger stall.

7. Apparatus of claim 4, wherein the texturing comprises protrusions formed with the finger stalls.

8. Apparatus of claim 1, wherein the package is openable and the glove removable therefrom.

9. Apparatus comprising:

a sealed package;

a glove disposed in the package and capable of being fitted over a human hand and having a palm;

lubricant disposed on the glove; and protrusions disposed at the palm of the glove for enhanced tactile sensation.

10. Apparatus of claim 9, the glove further including:

at least one finger stall; and protrusions disposed at the finger stall for enhanced tactile sensation.

11. Apparatus of claim 9, the glove further including:

a plurality of finger stalls; and protrusions disposed at the finger stalls for enhanced tactile sensation.

12. Apparatus of claim 9, wherein the package is openable and the glove removable therefrom.

13. Apparatus comprising:

a glove capable of being fitted over a human hand;

the glove having a palm;

lubricant disposed on the glove; and protrusions disposed on the palm of the glove for enhanced tactile sensation.

14. Apparatus of claim 13, the glove further including:

at least one finger stall; and the protrusions disposed at the finger stall.

15. Apparatus of claim 13, the glove further including:

a plurality of finger stalls; and the protrusions disposed at least one of the finger stalls.

16. Apparatus of claim 13, the glove further including:

a plurality of finger stalls; and the protrusions disposed at each of the finger stalls.

17. Apparatus of claim 13, further including a sealed package containing the glove.

18. Apparatus of claim 17, wherein the package is capable of being opened for accessing the glove.

19. A method comprising steps of:

providing a thin, flexible glove that is capable of being fitted over a human hand, with texturing formed on an outer surface of the glove for enhanced tactile sensation;

lubricating the glove with a lubricating gel; and disposing the glove within a sealed package.

* * * * *